United States Patent [19]

Bottau et al.

[11] Patent Number: 4,965,789

[45] Date of Patent: Oct. 23, 1990

[54] MULTI-RATE VOICE ENCODING METHOD AND DEVICE

[75] Inventors: Francoise Bottau, Nice; Claude Galand, Cagnes Sur Mer; Michele Rosso, Nice, all of France

[73] Assignee: International Business Machines Corporation, Armonk, N.Y.

[21] Appl. No.: 320,146

[22] Filed: Mar. 7, 1989

[30] Foreign Application Priority Data

Mar. 8, 1988 [EP] European Pat. Off. ..... 88480007

[51] Int. Cl.[5] ..... G10L 9/14

[52] U.S. Cl. ..... 370/79; 358/133; 375/27; 381/31

[58] Field of Search ..... 370/81, 79; 381/29, 381/307, 31, 32, 34, 35; 358/133, 135; 375/27, 30

[56] References Cited

U.S. PATENT DOCUMENTS

| | | | |
|---|---|---|---|
| 4,184,049 | 1/1980 | Crochiere et al. | 381/51 |
| 4,251,881 | 2/1981 | Ruether et al. | 370/81 |
| 4,267,407 | 5/1981 | Schindler et al. | 370/81 |
| 4,464,783 | 8/1984 | Beraud et al. | 381/31 |
| 4,589,130 | 5/1986 | Galand | 370/81 |
| 4,811,396 | 3/1989 | Yatsuzuka | 381/30 |
| 4,831,636 | 5/1989 | Taniguchi et al. | 358/133 |
| 4,866,510 | 9/1989 | Goodfellow et al. | 375/27 |
| 4,897,855 | 1/1990 | Acampora | 375/27 |

OTHER PUBLICATIONS

ICASSP 85, Proceedings of the IEEE International Conference on Acoustics, Speech, and Signal Processing, Tampa, 26th–29th Mar. 1985, vol. 4, pp. 1703–1706, IEEE, New York; A. Haoui et al.: "Embedded Coding of Speech: A Vector Quantization Approach", Paragraph 4.2: "Multistage Coders".

IBM Technical Disclosure Bulletin, vol. 29, No. 2, Jul. 1986, pp. 920–930, New York; "Multipulse Excited Linear Predictive Coder", Fig. 1.

ICASSP 83, Proceedings of the IEEE International Conference on Acoustics, Speech and Signal Processing, Boston, 14th–16th, Apr. 1983, vol. 3, pp. 1312–1315, IEEE, New York; L. Bertorello et al.: "Design of a 4.8/9.6 KBPS Baseband LPC Coder Using Split-Band and Vector Quantization", Para. 2.2: VQ of the Baseband.

*Primary Examiner*—Douglas W. Olms
*Assistant Examiner*—Melvin Marcelo
*Attorney, Agent, or Firm*—Edward H. Duffield

[57] ABSTRACT

The voice signal s(n) is filtered through a short-term predictive filter (13) tuned with PARCOR derived coefficients computed over a pre-emphasized s(n), said filter (13) providing a short-term residual r(n). Said r(n) signal is then processed through a first Cod-Excited/-Long-Term Predicative coder providing first couples of table address and gain data (k1, gl)'s. An error signal r'(n) is then derived by subtracting coded/decoded data from uncoded data. Then said error signal is processed through a second Code-Excited/Long-Term Predictive coder providing second couples of data (k2, g2)'s. Full rate coding is achieved by multiplexing both couples (k1, gl)'s and (k2, g2)'s into a multi-rate frame; while switching to a lower rate is achieved through a mere delation of (g2, k2)'s from the full rate frame.

7 Claims, 8 Drawing Sheets

MULTI-RATE VOICE ENCODING METHOD AND DEVICE

TECHNICAL FIELD OF THE INVENTION

This invention deals with voice coding techniques and more particularly with a method and means for multi-rate voice coding.

BACKGROUND OF THE INVENTION

Digital networks are currently used to transmit, and/or store where convenient, digitally encoded voice signals. For that purpose, each voice signal to be considered is, originally, sampled and each sample digitally encoded into binary bits. In theory, at least, the higher the number of bits used to code each sample the better the coding, that is the closest the voice signal would be when decoded before being provided to the end user. Unfortunately, for the network to be efficient from an economical stand point, the traffic or in other words the number of connected users acceptable without network congestion needs be maximized. This is one of the reasons why methods have been provided for lowering the voice coding bit rates while keeping the coding distortion (noise) at acceptable levels, rather than dropping users when traffic increases over a network. It looks reasonable to improve the voice coding quality when the traffic permits it and if needed lower said quality to a predetermined acceptable level under high traffic conditions. This switching from one quality (one bit rate) to another, should be made as simple and quick as possible at any node within the network. For that purpose, multirate coders should provide frames with embedded bit streams whereby switching from one predetermined bit rate to a lower predetermined rate would simply require dropping a predetermined portion of the frame.

SUMMARY OF THE INVENTION

One object of this invention is to provide means for multi-rate coding a voice signal using Code-Excited encoding techniques.

The voice signal is short-term filtered to derive a short-term residual therefrom, said short-term residual is submitted to a first Long-Term Predictive Code-Excited coding operation, then decoded and subtracted from the Code-Excited coding input to derive an Error signal, which Error signal is in turn Long-Term Predictive Code-Excited coded. Multi-rate frame involves both Long-Term Predictive Code-Excited coding.

More particularly, the present invention processes by short-term filtering the original voice signal to derive a voice originating short-term residual signal; submitting said short-term residual to a first Code-Excited (CE) coding operation including subtracting from said short-term residual a first predicted residual signal to derive a first long-term residual signal, coding said long term residual into a gain g1 and an address k1; subtracting said first reconstructed residual (after decoding) from the first long-term residual to derive a first Error signal therefrom; submitting said first Error signal to subsequent Code-Excited long-term prediction coding into g2 and k2; and aggregating (g1, k1) and (g2, k2) into a same multi-rate coded frame, whereby switching to a lower rate coded frame would be achieved through dropping (g2, k2).

Obviously, the above principles may be extended to a higher number of rates by extending it to third, fourth, etc, . . . Code-Excited coding.

Further objects, characteristics and advantages of the present invention will be explained in more details in the following, with reference to the enclosed drawings, which represent a preferred embodiment.

The foregoing and other objects, features and advantages of the invention will thereof be made apparent from the following more particular description of a preferred embodiment of the invention as illustrated in the accompanying drawings.

DESCRIPTION OF PREFERRED EMBODIMENTS

Figure 1:
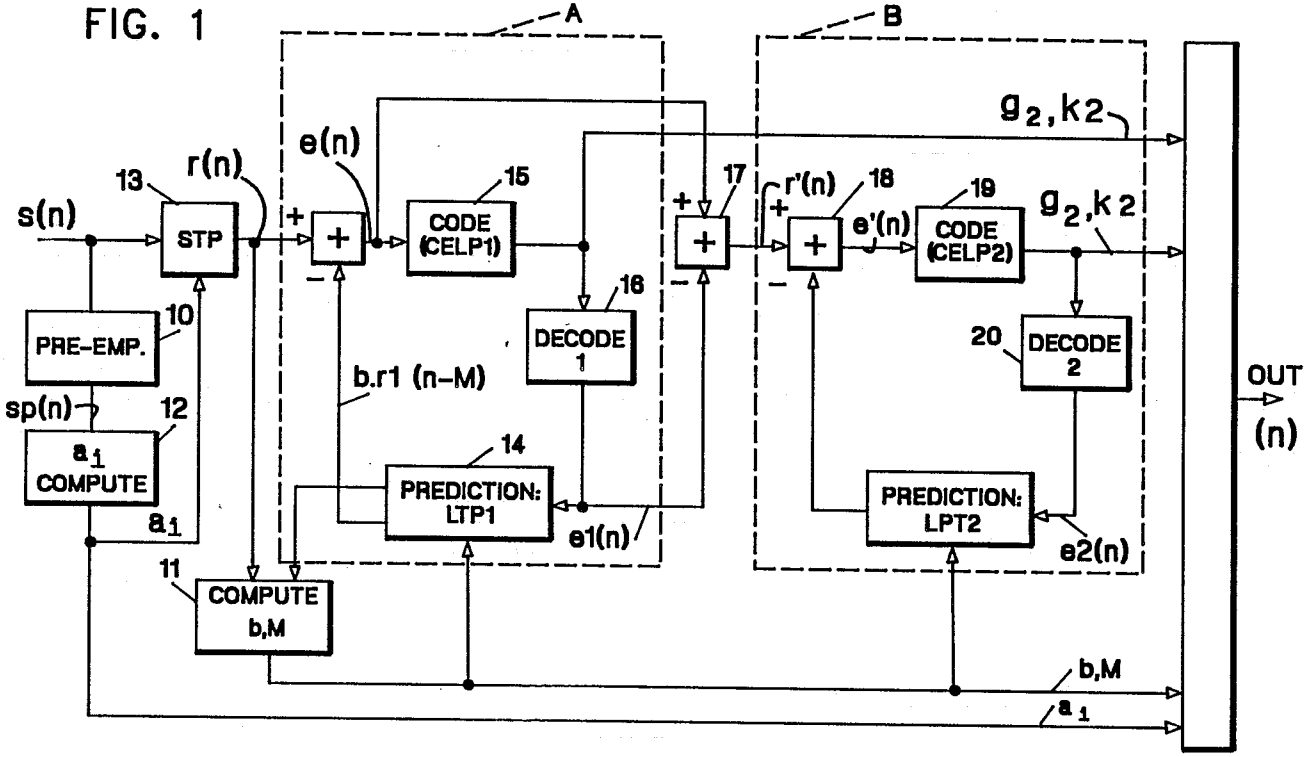
FIG. 1 is a block diagram of a coder according to the invention.

Represented in FIG. 1 is a simplified block diagram of a bi-rate coder, which, as already mentioned, might be extended to a higher number of rates.

The voice signal limited to the telephone bandwidth (300 Hz-3300 Hz), sampled at 8 KHz and digitally PCM encoded with 12 bits per sample in a conventional Analog to Digital Converter (not shown) provides samples s(n). These samples are first pre-emphasized in a device (10) and then processed in a device (12) to generate sets of partial autocorrelation derived coefficients (PARCOR derived) $a_i$'s. Said $a_i$ coefficients are used to tune a short term predictive filter (STP) (13) filtering s(n) and providing a short-term residual signal r(n). Said short-term residual is coded into a first Code-Excited long-term prediction coder (A). To that end, it is processed to derive therefrom a first long-term residual e(n) by subtracting from r(n), a predicted first residual signal corresponding to the synthesized (reconstructed) first residual delayed by a predetermined delay M (equal to a multiple of the voice pitch period) and multiplied by a gain factor b.rl(n-M) using as first long-term predictor.

It should be noted that for the purpose of this invention block coding techniques are used over r(n) blocks of samples, 160 samples long. Parameters b and M are evaluated every 80 samples. The flow of residual signal samples e(n) is subdivided into blocks of L consecutive samples and each of said blocks is then processed into a first Code-Excited coder (CELP1) (15) where K sequences of L samples are made available as normalized codewords. Coding e(n) involves then selecting the codeword best matching the considered e(n) sequence in mean squared error criteria consideration and replacing e(n) by a codeword reference number k1. Assuming the pre-stored codewords be normalized, then a first gain coefficient g1 should also be determined and tested.

Once k1 is determined, a first reconstructed residual signal e1(n)=g1. CB(k1) generated in a first decoder (DECODE1) (16) is fed into said long-term predictor (14).

Said reconstructed residual is also subtracted from e(n) in a device (17) providing an error signal r'(n).

The error signal r'(n) is then fed into a second Code-Excited/Long-Term Prediction coder similar to the one described above. Said second coder includes a subtractor (18) fed with the error signal r'(n) and providing an error residual signal e'(n) addressing a second Code-Excited coder CELP2 (19). Said device (19) codes e'(n) into a gain factor g2 and a codeword address k2. Said coder is also made to feed the codeword CB(k2) and gain g2 into a decoder (20) providing a decoded error signal $$e2(n)=g2\cdot CB(k2)$$

Said signal e2(n) is also fed into a second Long-Term Predictor (LTP2) similar to LTP1 and the output of which is subtracted from r'(n) in device (18).

Finally a full rate frame is generated by multiplexing the $a_i$'s b's, M's, (g1, k1)'s and (g2, k2)'s data into a multirate (bi-rate) frame.

As already mentioned, the process may easily be further extended to higher rates by serially inserting additional Code-Excited/Long-Term Predictive coders such as A or B.

Figure 2:
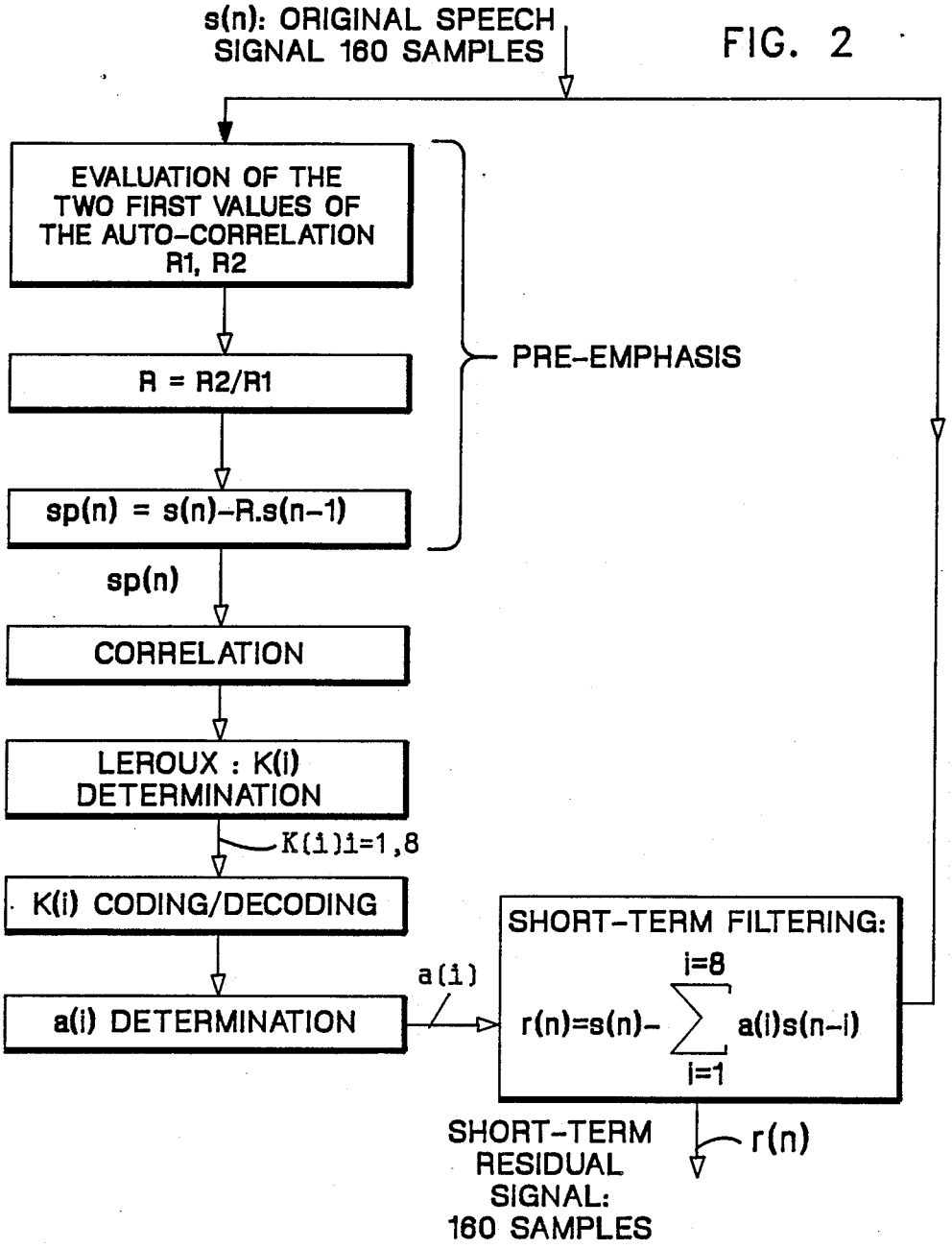
FIG. 2 is a flow chart for the operations involved in devices 10, 12 and 13 of FIG. 1.

Represented in FIG. 2 is a flow chart showing the detailed operations involved in both pre-emphasis and PARCOR related computations. Each block of 160 signal samples s(n) is first processed to derive two first values of the signal auto-correlation function :

$$R1 = \sum_{j=1}^{160} s(j)\cdot s(j)$$

$$R2 = \sum_{j=2}^{160} s(j-1)\cdot s(j)$$

The pre-emphasis coefficient R is then computed $$R=R1/R2$$

and the original set of 160 samples s(n) are converted into a pre-emphasized set sp(n)

$$sp(n)=s(n)-R\cdot s(n-1)$$

The pre-emphasized $a_i$ parameters are derived by a step-up procedure from so-called PARCOR coefficients $K_i$ in turn derived from the pre-emphasized signal sp(n) using a conventional Leroux-Guegen method. The eight $a_i$ or PARCOR $K_i$ coefficients may be coded with 28 bits using the Un/Yang algorithm. For reference to these methods and algorithm, one may refer to:

J. Leroux and C. Guegen: "A fixed point computation of partial correlation coefficients" IEEE Transactions on ASSP pp 257–259, June 1977;

C.K. Un and S.C. Yang "Piecewise linear quantization of LPC reflexion coefficients" Proc. Int. Conf. on QSSP Hartford, May 1977.

L.D. Markel and A.H. Gray: "Linear prediction of speech" Springer Verlag 1976, Step-up procedure pp 94–95.

European Patent 2998 (U.S. Pat. No. 4,216,354) assigned to this assignee.

The short term filter (13) derives the short-term residual signal samples :

$$r(n) = s(n) - \sum_{i=1}^{8} a_i\cdot s(n-i)$$

Several methods are available for computing the long-term factors b and M values. One may for instance refer to B.S. Atal "Predictive Coding of Speech at low Bit Rate" published in IEEE Trans on Communication, Vol. COM-30, April 1982, or to B.S. Atal and M.R. Schroeder, "Adaptive prediction coding of speech signals", Bell System Technical Journal; Vol 49, 1970.

Generally speaking, M is a pitch value or an harmonic of it and methods for computing it are known to a man skilled in the art.

A very efficient method was also described in a copending European application (cf FR987004) to the same assignee.

According to said application:

$$b = \frac{\sum_{n=1}^{80} r(n)\cdot r1(n-M)}{\sum_{n=1}^{80} [r1(n-M)]^2}$$

with b and M being determined twice over each block of 160 samples, using 80 samples and their 80 predecessors.

The M value, i.e. a pitch related value, is therein computed based on a two-step process. A first step enabling a rough determination of a coarse pitch related M value, followed by a second (fine) M adjustment using auto-correlation methods over a limited number of values.

1. First step:

Rough determination is based on use of non-linear techniques involving variable threshold and zero crossing detections more particularly this first step includes:

initializing the variable M by forcing it to zero or a predefined value L or to previous fine M;

loading a block vector of 160 samples including 80 samples of current sub-block, and the 80 previous samples;

detecting the positive (Vmax) and negative (Vmin) peaks within said 160 samples;

computing thresholds positive threshold Th+=alpha·Vmax negative threshold Th−=alpha·Vmin alpha being an empirically selected value (e.g. alpha =0.5)

setting a new vector X(n) representing the current sub-block according to:

$$X(n) = 1 \text{ if } r(n) \geqq Th^+$$

$$X(n) = 1 \text{ if } r(n) \leqq Th^-$$

$$X(n) = 0 \text{ otherwise}$$

This new vector containing only −1, 0 or 1 values will be designated as "cleaned vector";

detecting significant zero crossings (i.e. sign transitions) between two values of the cleaned vector i.e. zero crossing close to each other;

computing M' values representing the number of r(n) sample intervals between consecutive detected zero crossings;

comparing M' to the previous rough M by computing $\Delta M = |M' - M|$ and dropping any M' value whose $\Delta M$ is larger than a predetermined value D (e.g. D=5);

computing the coarse M value as the mean value of M' values not dropped.

2. Second step:

Fine M determination is based on the use of autocorrelation methods operated only over samples taken around the samples located in the neighborhood of the pitched pulses.

Second step includes:

Initializing the M value either as being equal to the rough (coarse) M value just computed assuming it is different from zero, otherwise taking M equal to the previous measured fine M;

locating the autocorrelation zone of the cleaned vector, i.e. a predetermined number of samples about the rough pitch;

computing a set of R(k') values derived from:

$$R(k') = \sum_{n=1}^{80} r(n) \cdot r1(n-k)$$

with k' being the cleaned vector sample index varying from a lower limit Mmin to the upper limit Mmax of the selected autocorrelation zone, with limits of the autocorrelation zone Mmin=L, Mmax=120 for example.

Once b and M are computed, they are used to tune the inverse Long-Term Predictor (14) as will be described further. The output of the device (14) i.e. a predicted first long-term residual subtracted to r(n) provides first long-term residual signal e(n). Said e(n) is in turn, coded into a coefficient k1 and a gain factor g1. The coefficient k1 represents the address of a codeword CB(k1) pre-stored into a table located in the device (CELP1) (15). The codeword and gain factor selection is based on a mean squared error criteria consideration; i.e. by looking for the k table address providing a minimal E, with:

$$E = [e(n) - g1 \cdot CB(k,n)]^T \cdot [e(n) - g1 \cdot CB(k,n)] \quad (1)$$

wherein:

T: means mathematical transposition operation. CB(k,n)=represents the codeword located at the address k within the coder 15 of FIG. 1.

In other words, E is a scalar product of two L components vectors, wherein L is the number of samples of each codeword CB.

The optimal scale factor G(k) [g1 in (1)] that minimizes E is determinated by setting:

$$\frac{dE}{dG} = 0$$

and $$G(k) = \frac{e(n)^T \cdot CB(k,n)}{\| CB(k,n) \|^2}$$

The denominator of equation G(k) is a normalizing factor which could be avoided by pre-normalizing the codewords within the pre-stored table.

The expression (1) can be reduced to:

$$E = |e(n)|^2 - \frac{[e(n)^T \cdot CB(k,n)]^2}{\| CB(k,n) \|^2} \quad (2)$$

and the optimum codeword is obtained by finding k maximizing the last term of equation (2).

Let CB2(k) represent $CB(k,n)^2$ and, SP(k) be the scalar product $e^T(n) \cdot CB(k,n)$, Then one has first to find k providing a term $$\frac{[SP(k)]^2}{CB2(k)}$$

maximum, and then determine the G(k) value from $$G = \frac{SP(k)}{CB2(k)}$$

The above statements could be differently expressed as follows:

Let {en} with n=1, 2, . . . , L represent the sequence of e(n) samples to be encoded. And let $\{Y_n^k\}$ with n=1, 2, . . . , L and k=1, 2, . . . , K, where $K = 2^{cbit}$, represent a table containing K codewords of L samples each.

The CELP encoding would lead to:

computing correlation terms:

$$Ek = \sum_{n=1}^{L} en \cdot Y_n^k$$

for k=1, . . . , K selecting the optimum value of k leading to

Ekopt=Max (Ek)
k=1, . . . , K converting the e(n) sequence into a block of cbit $= \log_2 K$ bits, plus the G(k) encoding bits.

Figure 3:
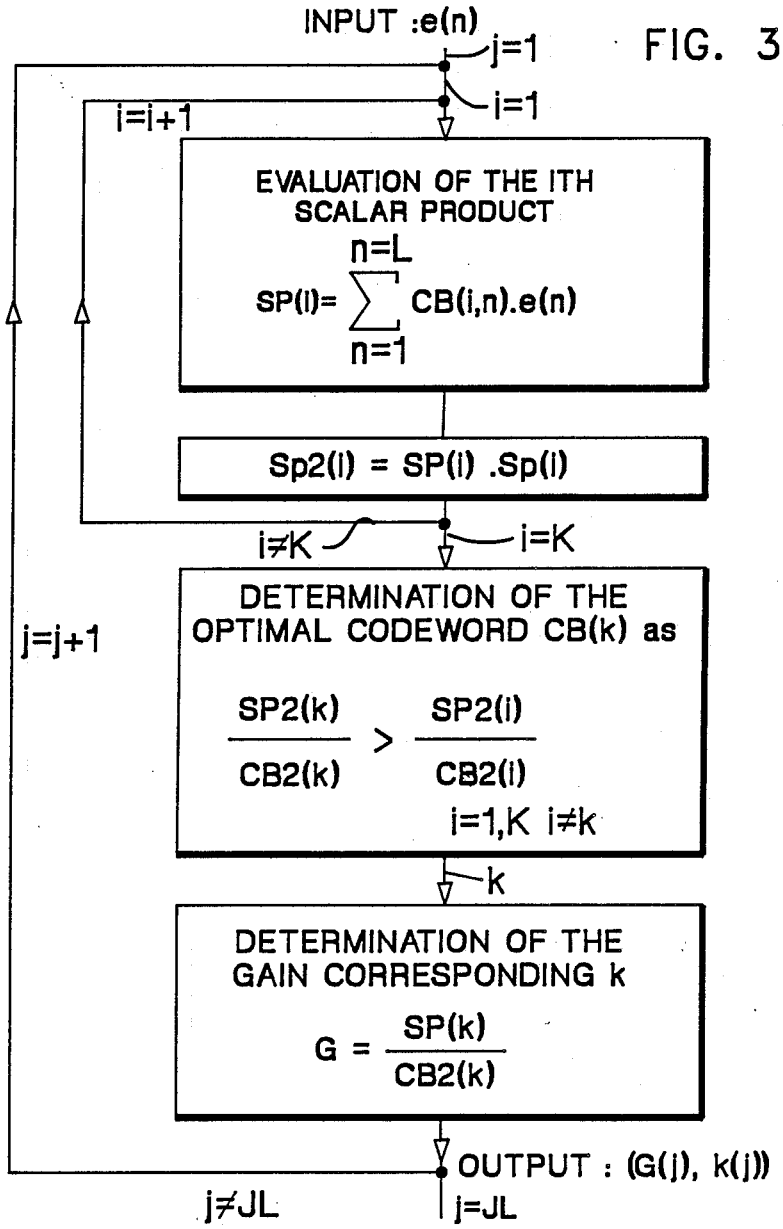
FIG. 3 is a flow chart for Code-Excited coding operations.

The algorithm for performing the above operations is represented in FIG. 3.

First two index counters i and j are set to i=1 and j=1. The table is sequentially scanned. A codeword CB(l,n) is read out of the table.

A first scalar product is computed $$SP(1) = \sum_{n=1}^{L} CB(1,n) \cdot e(n) \quad (3)$$

This value is squared into SP2(1) and divided by a squared value of the corresponding codeword [i.e. CB2(1)]. i is then incremented by one and the above operations are repeated until i=K, with K being the number of codewords in the code-book. The optimal codeword CB(k), which provides the maximum $$\frac{SP2(k)}{CB2(k)}$$

within the sequence $$\frac{SP2(i)}{CB2(i)}$$

for i=1, . . . , K is then selected. This operation enables detecting the table reference number k.

Once k is selected, then the gain factor computed using:

$$G = \frac{SP(k)}{CB2(k)}$$

Assuming the number of samples within the sequence e(n) is selected to be a multiple of L, then said sequence e(n) is subdivided into JL windows each L samples long, then j is incremented by 1 and the above process is repeated until j =JL.

Computations may be simplified and the coder complexity reduced by normalizing the codebook in order to set each codeword energy to the unit value. In other words, the L component vector amplitude is normalized to one $$CB2(i)=1 \text{ for } i=1, \ldots, K$$

In that case, the expression determining the best codeword k is simplified (all the denominators involved in the algorithm are equal to the unit value). The scale factor G(k) is changed whereas the reference number k for the optimal sequence is not modified.

This method would require a memory fairly large to store the table. For instance said size K×L may be of the order of 40 kilobits for K=256 and L=20.

A different approach is recommended here. Upon initialization of the system, a first block of L+K samples of residual signal, e.g. e(n) would be stored into a table. Then each subsequent L-word long sequence e(n) is correlated with the (L+K) samples long table sequence by shifting the (en) sequence from one sample position of the next, over the table.

$$Ek = \sum_{n=1}^{L} en \cdot Y(n + k - 1)$$

for k=1, . . . , K.

This method enables reducing the memory size required for the table, down to 2 kilobits for K=256, L=20 or even lower.

Figure 4:
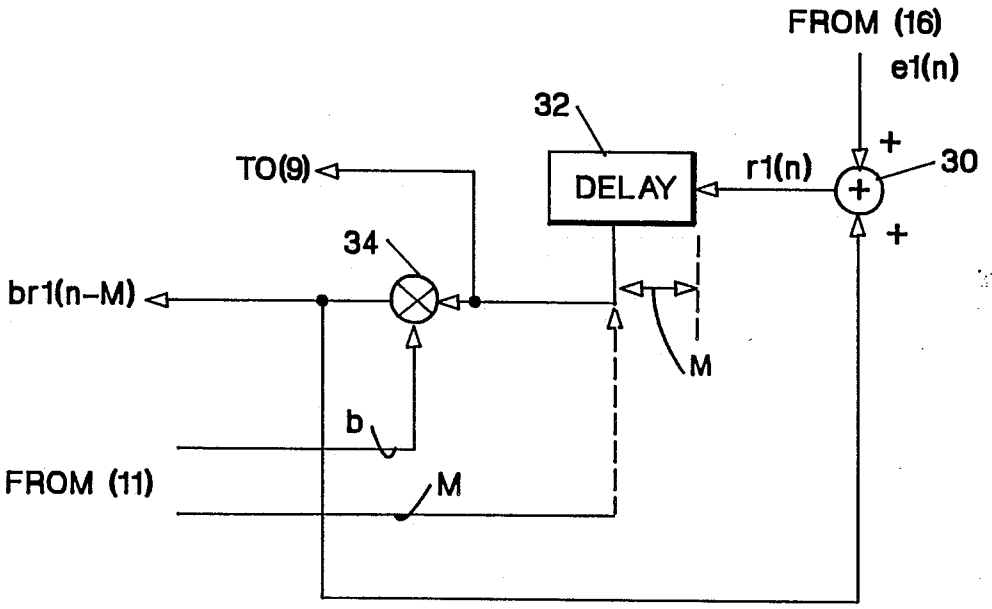
FIG. 4 is a block diagram for implementing the device 14 of FIG. 1.

Represented in FIG. 4 is a block diagram for the inverse Long-Term Predictor (14). Once selected in the coder (15), the first reconstructed residual signal $$e1(n)=g1 \cdot CB(k1)$$

provided by device (16), is fed into an adder (30), the output of which is fed into a variable delay line the length of which is adjusted to M. The M delayed output of variable delay line (32) is multiplied by the gain factor b into multiplier (34). The multiplied output is fed into adder (30).

As represented in FIG. 1, the b and M values computed may also be used for the subsequent Code-Excited coding of the error signal derived from subtracting a reconstructed residual from a long term residual.

Figure 5:
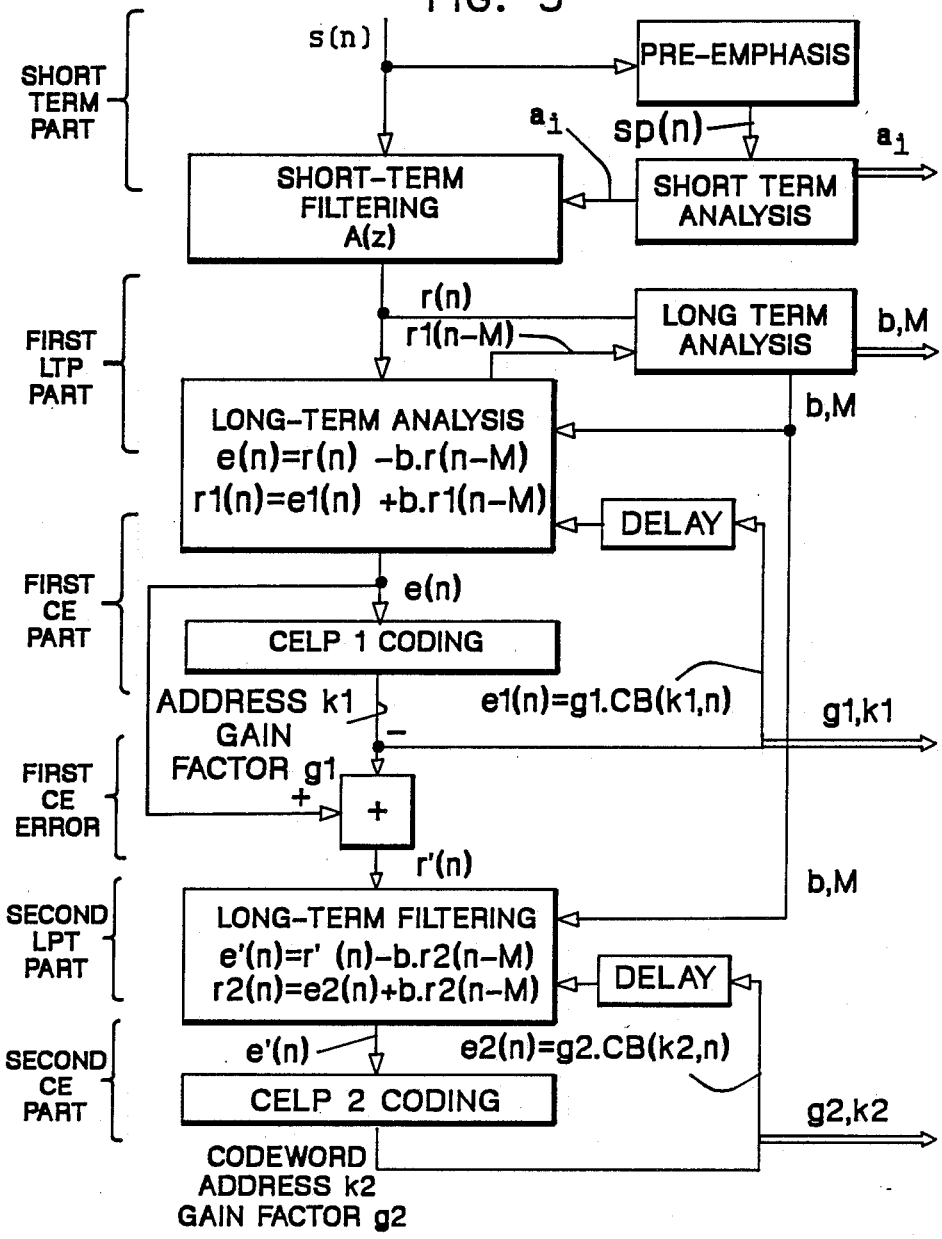
FIG. 5 is a flow chart of the process of the invention as applied to device of FIG. 1.

Represented in FIG. 5 is an algorithm showing the operations involved in the multi-rate coding according to the invention assuming multi-rate be limited to two rates for sake of simplification of this description.

The process may be considered as including the following steps:

(1) Short-Term:

The s(n) signal is converted into a short-term residual r(n) through a short-term filtering operation using a digital filter with a(i) coefficients; Said coefficients are signal dependent coefficients derived from a pre-emphasized signal sp(n) through short-term analysis operations.

(2) First Long-Term Prediction

The short-term residual signal r(n) is converted into a first long-term residual e(n), with:

$$e(n)=r(n)-b \cdot r1(n-M),$$

wherein: b is a gain factor derived from the short-term residual analysis, M is a pitch multiple; and rl(n-M) is derived from a reconstructed previous long-term residual, delayed by M.

(3) First Code-Excited Coding

The first long-term residual signal is coded into a first codeword table address (k1) and a first gain factor (g1). This is achieved by correlating a predetermined length block of e(n) samples with pre-stored codewords to determine the address k1 of the codeword best matching said block (4) First Code-Excited coding error A coding error signal r'(n) is derived by subtracting a decoded e1(n) from the uncoded e(n).

(5) Second Long-Term Prediction:

The error signal is in turn converted into an error residual e'(n) through a second long-term residual operation similar to the previous one, i.e. using the already computed M and b coefficients to derive:

$$e'(n)=r'(n)-b \cdot r2(n-M).$$

(needless to mention that keeping for this second step the previously computed b and M coefficients helps saving in computing workload. Recomputing these might also be considered).

(6) Second Code-Excited Coding:

The error residual signal is in turn submitted to Code-Excited coding providing a best matching second codeword address (k2) and a second gain factor (g2).

The above process provides the data $a_i$, b's, M's, (g1, k1)'s and (g2, k2)'s to be inserted into a bi-rate frame using conventional multiplexing approaches. Obviously, the process may be extended further to a higher number of rates by repeating the three last steps to generate (g3, k3)'s, (g4, k4)'s, etc, . . .

Figure 6:
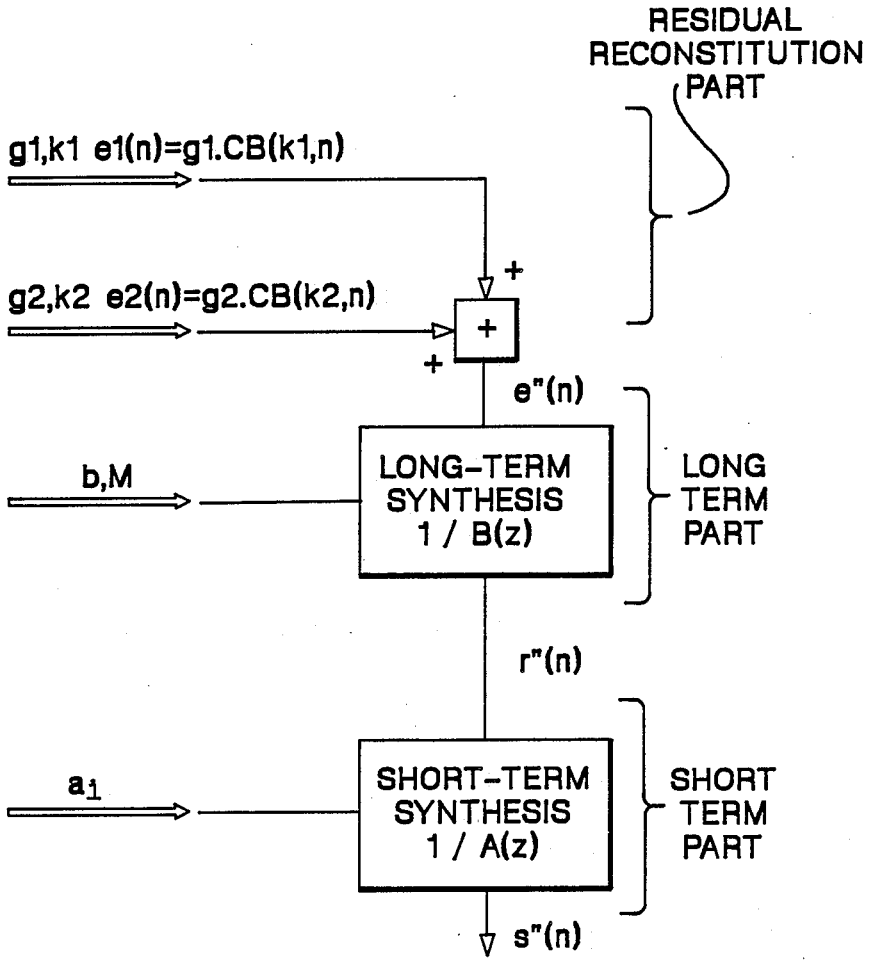
FIG. 6 is a flow chart for the decoder to be used with the invention.

Synthesizing back the original voice signal from the multi-rate (bi-rate) frame may be achieved as shown in the algorithm of FIG. 6, assuming the various data had previously been separated from each other through a conventional demultiplexing operation. The k1 and k2 values are used to address a table, set as mentioned above in connection with the coder's description, to fetch the codewords CB(k1) and CB(k2) therefrom. These operations enable reconstructing:

$$el(n)=g1 \cdot CB(k1, n)$$

$$e2(n)=g2 \cdot CB(k2, n)$$

Then $$e''(n)=e1(n)+e2(n)$$

Said e''(n) is then fed into a long-term synthesis filter 1/B(z) tuned with b and M and providing r''(n).

r''(n) is then filtered by a short-term synthesis digital filter 1/A(z) tuned with the set of $a_i$ coefficients, and providing the synthesized voice signal s''(n).

Figure 7:
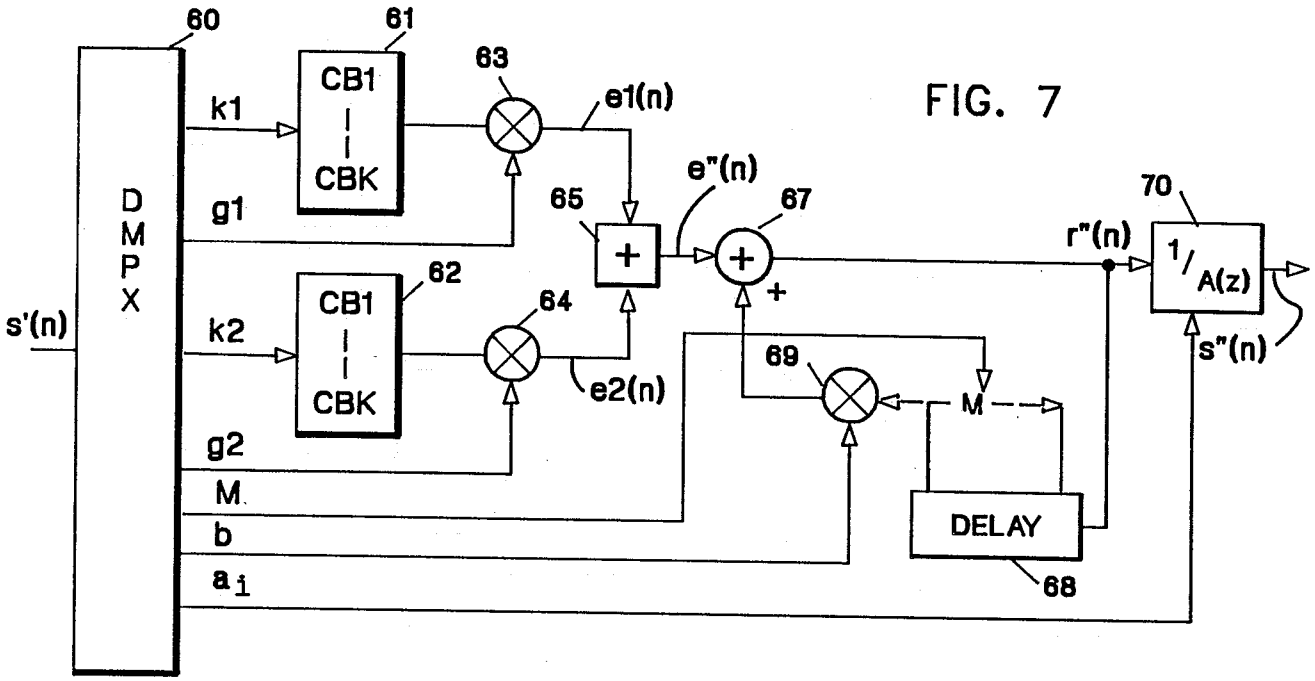
FIG. 7 is a block diagram of said decoder.

A block diagram arrangement of the above synthesizer (receiver) is represented in FIG. 7. A demultiplexor (60), separates the data from each other. k1 and k2 are used to address the tables (61) and (62), the output of which are fed into multipliers (63) and (64) providing el(n) and e2(n). An adder (65) adds el(n) to e2(n) and feeds the result into the filter 1/B(z) made of adder (67), a variable delay line (68) adjusted to length M, and a multiplier (69). The output of adder (67) is then filtered through a digital filter (70) with coefficients set to $a_i$ and providing the synthesized back voice signal s''(n).

Figure 8:
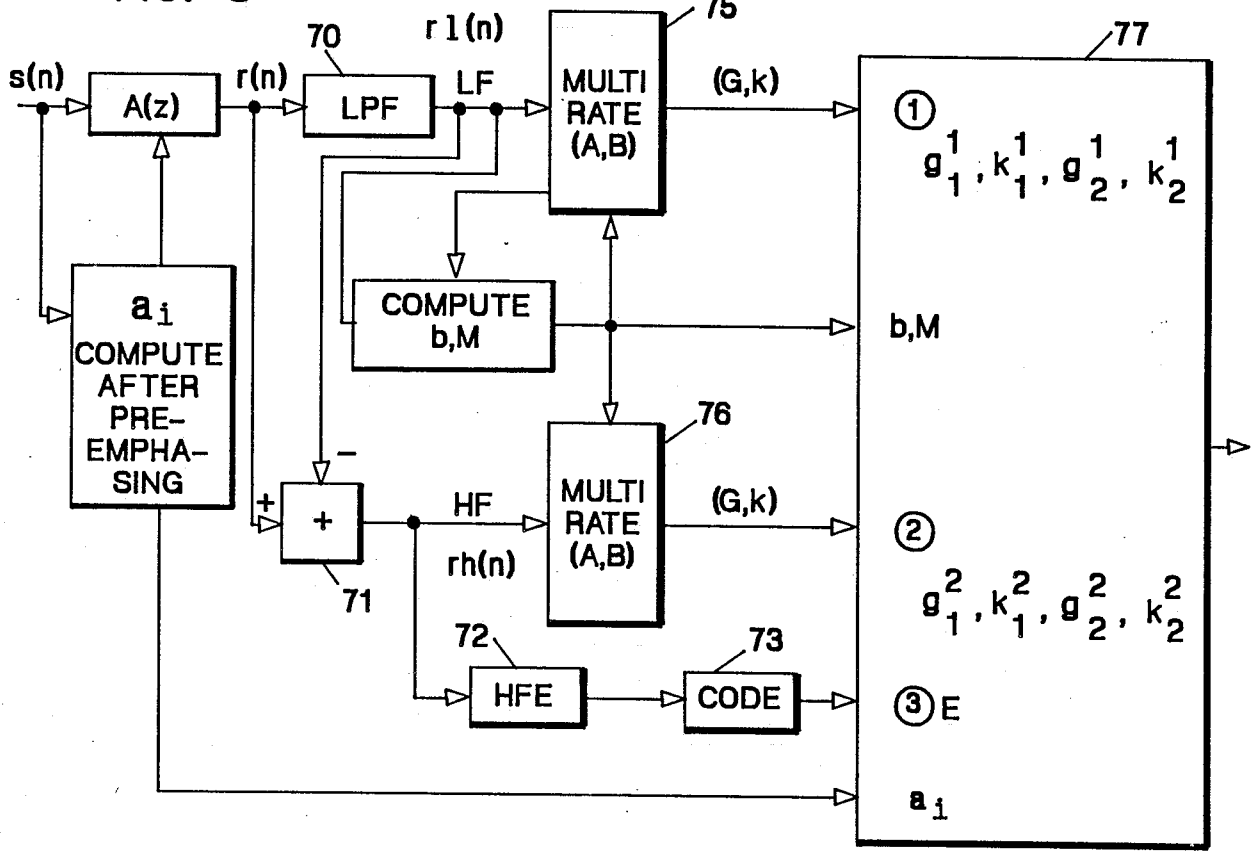
FIG. 8 is a block diagram for the coder according to the invention, applied to base-band coding.

The multi-rate approach of this invention may be implemented with more sophisticated coding schemes. For instance, it applies to conventional Base-band coders as represented in FIG. 8. Once the original voice signal s(n) has been processed to derive the short-term residual r(n), it is split into a low frequency bandwidth (LF) signal rl(n) and a high bandwidth (HF) signal rh(n) using a low-pass filter LPF (70) and adder (71). The high bandwidth energy is computed into a device HFE (72) and coded in (73) into a data designated by E. The output of 73 has been labelled (3). Each one of the bandwidths LF and HF signals, i.e. rl(n) and rh(n) is fed into a multirate CE/LTP coder (75), (76) as represented by (A) and (B) blocks of FIG. 1. Also either separate (b,M) computing devices or a same one will be used for both bandwidths.

Finally, fed into a multiplexer (77) are the following sets of data:

PARCOR related coefficients: $a_i$

Pitch or long-term related data: b's and M',s

High frequency energy data: E's

Low bandwidth multi-rate CE/LTP:

$$g_1^{1\text{'s}};\ k_1^{1\text{'s}};\ g_2^{1\text{'s}};\ k_2^{1\text{'s}}$$

High bandwidth multi-rate CE/LTP:

$$g_1^{2\text{'s}};\ k_1^{2\text{'s}};\ g_2^{2\text{'s}};\ k_2^{2\text{'s}}$$

This approach enables coding at several rates, with sets of data common to all rates, i.e. the $a_i$, b and M parameters and the remaining data being inserted or not in the output frame according to the following approaches for instance:

Full band coder with a bit rate of 16 Kbps: add $$g_1^1;\ k_1^1;\ g_2^1;\ k_2^1;\ g_1^2;\ k_1^2;\ g_2^2;\ \text{and } k_2^2.$$

Medium band coder:

$$g_1^1;\ k_1^1;\ g_2^1;\ k_2^1;\ g_1^2 \text{ and } k_1^2 \text{ only.}$$

Low band coder:

$$g_1^1;\ k_1^1;\ g_2^1;\ k_2^1;\ \text{and } E$$

Lower rate coder:

$$g_1^1;\ k_1^1;\ E.$$

Obviously, other types of combinations of outputs (1), (2) and (3), $a_i$, b, M and E might be considered without departing from the scope of this invention.

We claim:

1. A process for multirate encoding a voice originating signal using Code-Excited techniques wherein the voice originating signal is considered by blocks of samples and each block is subsequently converted into a prestored table address k and a gain factor g, said multirate process including:

first Code-Excited coding said voice originating block into a first table address k1 and a gain g1;

decoding said first Code-Excited coded block;

subtracting said decoded block from a non-coded voice originating block to derive an error signal block therefrom;

second Code-Excited coding said error signal block into a second table address k2 and a gain g2; and multiplexing both (g1, k1) and (g2, k2) data into a single full rate frame;

whereby coding at a lower predetermined rate is achieved by simply dropping g2 and k2 from the considered frame.

2. A process for multirate encoding a voice originating signal according to claim 1 wherein said voice originating signal is represented by a residual signal derived from the original voice signal to be coded by filtering said original voice signal through a self adjusted short-term filtering operation.

3. A process for multirate encoding a voice signal according to claim 2, wherein said short-term filtering is tuned using PARCOR derived coefficients $a_i$'s computed using a pre-emphasized voice signal.

4. A process according to claim 2 or 3 wherein said Code-Excited coding involves first subtracting a Long-Term Predicted decoded signal from the residual signal, and then Code-Excited coding the difference.

5. A device for multi-rate digitally encoding a voice signal s(n) including:

computing means (10,12) for pre-emphasizing s(n) and deriving from said pre-emphasized s(n), autocorrelation derived coefficients $a_i$;

short-term filtering means (13) tuned by said $a_i$ coefficients and connected to filter s(n) into a short-term residual r(n);

a first Code-Excited coding means including:

first subtracting means having a (+) input fed with said residual r(n) and providing a long-term residual e(n);

Code-Excited coding means (15) for converting blocks of e(n) samples into a first table address k1 and a first gain g1;

decoding means (16) connected to said Code-Excited coding means;

inverse Long-Term Predictive filtering means (14) connected to said decoding means, the output of said Long-Term Predictive filtering means (14) being fed to the (−) input of said first subtracting means;

long-term computing means filter (11) connected to said short-term filtering means and to said inverse Long-Term Predictive means for providing b and M factors for tuning said Long-Term Predictive filter (14), where said b and M factors are the long-term gain factors;

second subtracting means (17) having a (+) input connected to receive said long-term residual e(n) and a (−) input connected to said decoding means (16), said subtracting means (17) providing an error signal r'(n);

second Code-Excited coding means similar to said first Code-Excited coding means, fed with said error signal r'(n) and providing second table address k2 and gain g2;

multiplexing means for multiplexing $a_i$'s; b's; M's; (g1, k1)'s and (g2, k2)'s into a single full rate frame.

6. A device for decoding the signal digitally coded by the coder according to claim 5, said decoder including:

demultiplexing means for separating $a_i$, b's, M's, g1's, k1's, g2's and k2's from each other;

table means (61-62) addressed with k1 and k2;

multiplier means (63-64) connected to said table means and multiplying said tables outputs by g1, and g2 respectively;

first adding means (65) connected to said multipliers output.

second adding means (67) having a first input connected to first adding means, and a second input fed with said second adding means output through a delay line adjusted to M and a multiplier by b; and, short-term inverse filtering means (70) tuned with $a_i$'s coefficients and connected to said second adder.

7. A base-band multi-rate coder for coding a voice signal according to claim 5 wherein said residual signal is split into a low frequency bandwidth signal rl(n) and a high frequency bandwidth signal rh(n), said rh(n) and rl(n) being subsequently multirate encoded into couples.

$(g_1^1, k_1^1,)$'s $(g_2^1, k_2^1)$'s, $(g_1^2, k_1^2)$'s and $(g_2^2, k_2^2)$'s.

* * * * *